United States Patent [19]

Taguchi et al.

[11] Patent Number: 4,892,466

[45] Date of Patent: Jan. 9, 1990

[54] VARIABLE CAPACITY COMPRESSOR

[75] Inventors: Tatsuhisa Taguchi, Katano; Yoshikazu Abe, Neyagawa, both of Japan

[73] Assignee: Matsushita Electric Industrial Co., Ltd., Kadoma, Japan

[21] Appl. No.: 196,592

[22] Filed: May 20, 1988

[30] Foreign Application Priority Data

May 20, 1987 [JP] Japan ..... 62-122913

[51] Int. Cl.[4] ..... F04B 49/02

[52] U.S. Cl. ..... 417/295; 417/310

[58] Field of Search ..... 417/295, 310, 222 S

[56] References Cited

U.S. PATENT DOCUMENTS 3,026,809 3/1962 Anderson et al. ..... 418/171
4,726,740 2/1988 Suzuki et al. ..... 417/295
4,780,059 10/1988 Taguchi ..... 417/222
4,815,944 3/1989 Maruyama et al. ..... 417/295

FOREIGN PATENT DOCUMENTS 220801 5/1987 European Pat. Off. ..... 417/295
55380 3/1986 Japan ..... 417/222 S
51785 3/1987 Japan ..... 417/310

*Primary Examiner*—Leonard E. Smith
*Attorney, Agent, or Firm*—Cushman, Darby & Cushman

[57] ABSTRACT

In a pressure control valve (28) of a variable capacity compressor, a pressure detecting part (48) which compares suction pressure of the compressor with atmospheric pressure, a valve (52) urged to close by a spring (53), a rod driven by the pressure detecting part and an electromagnetic coil (55) for attracting and opening the valve are provided, thereby to change capacity of the compressor continuously.

1 Claim, 8 Drawing Sheets

FIG, 8(Prior Art)
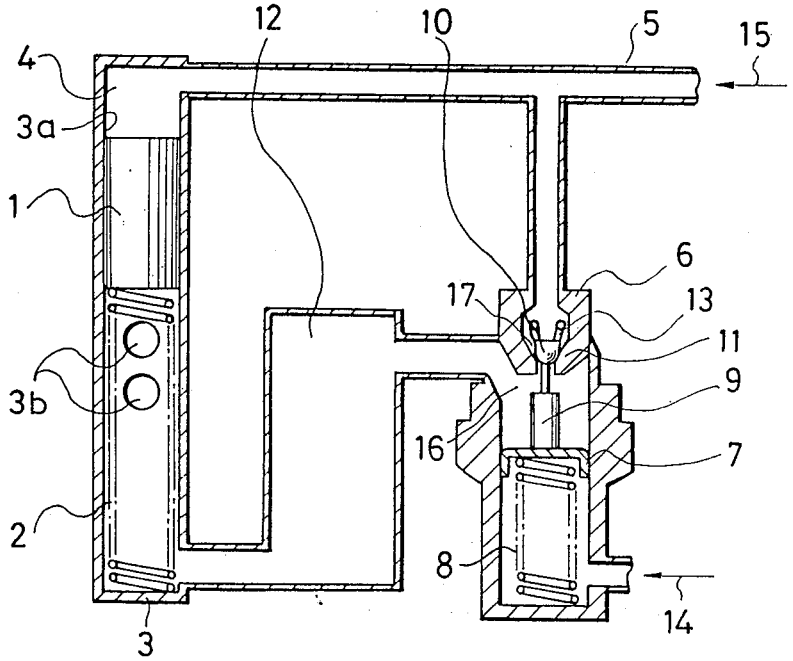

VARIABLE CAPACITY COMPRESSOR

FIELD OF THE INVENTION AND RELATED ART STATEMENT

1. Field of the Invention

The present invention relates to a compressor which is applicable, for instance, for an air conditioner of a car, and more particularly relates to an improvement in a variable capacity compressor.

2. Description of the Related Art

Recently, improvement in a compressor which is used for an air conditioner of a car has been directed to development of a variable capacity compressor for enabling saving power and improving comforts. In 1986, a rotary type compressor, which is superior to a reciprocation type compressor in respects of compactness and silence and is possible to control capacity by providing of a bypass cylinder, was put on market by Nippon Denso Co., LTD. A basic structure of control mechanism of the compressor is shown in FIG. 8. In the figure, an enclosure 3 has a cylindrical inner wall 3*a* and plural bypass holes 3*b* connected to a high pressure compartment of a cylinder (not shown). A cylindrical spool valve 1, which is slidably disposed inside the enclosure 3, is urged by a spring 2 in a direction to make the bypass holes 3*b* open. High pressure gas 15 compressed by a compressor (not shown) is fed from a high pressure lead-in pipe 5 to a pressure control compartment 4 which is formed above the spool valve 1. Pressure in the pressure control compartment 4 is controlled by a pressure control valve 6 which comprises a diaphragm 7, a spring 8, a rod 9, a valve 10, a valve bank 11 and a spring 13. The diaphragm 7 is transformed responding pressure balance between suction pressure led from a suction compartment 12 above the diaphragm 7 and an urge of the spring 8 encouraged by atmospheric pressure 14. The rod 9 and the valve 10 are connected to the diaphragm 7, and the valve 10 is pushed to the valve bank 11 by the spring 13.

When the suction pressure decreases below a predetermined pressure $P_{so}$ determined by force of the spring 8, the diaphragm 7 transforms upward, and thereby the valve 10 is detached from the valve bank 11 and a gap 17 is formed between the valve 10 and the valve bank 11. At that time, high pressure gas in the pressure control compartment 4 flows to the suction compartment 12 through the gap 17 and a space 16 above the diaphragm 7. As a result, since the pressure in the pressure control compartment 4 is lowered, the spool valve 1 is raised by the spring 2, and thereby the bypass holes 3 are gradually opened from the spool valve 1. Thereby, some amount of the gas exhausted out of the cylinder comes in the enclosure 3 through the bypass holes 3*b* and returns to the suction compartment 12. Thus, amount of the gas which is exhausted out of the compressor decreases as a result of the bypassing through the bypass holes 3*b*, and thereby pressure balance between the suction pressure and the exhaust pressure in refrigerating cycle is changed and the suction pressure increases. When the suction pressure increases, a transformation of the diaphragm 7 is reduced and the gap 17 between the valve 10 and the valve bank 11 is made small. As a result, since amount of the gas which flows through the gap 17 decreases, the pressure in the pressure control compartment 4 increases. And, the spool valve 1 moves to shut the bypass holes 3*b* again. By repeating the above-mentioned operation, control for keeping the suction pressure constant is achieved.

In the above-mentioned control for keeping the suction pressure constant, cooling capacity of the compressor is kept constant independent from a change of rotation speed of the compressor by keeping the pressure in an evaporator (not shown), hence temperature at an exit of the evaporator, approximately contant. In other wards, this compresor offers an appropriate cooling capacity corresponding to a required cooling capacity of a room of the car. However, when rapid cooling is required just after starting of the compressor, temperature in the room lowers slowly in comparison with temperature in the exit of the evaporator. Further, when sensible temperature by a driver is higher than a true temperature in the room, the driver feels uncomfortable. That is, the control for keeping the suction pressure constant results in such state of the compressor that the cooling capacity is limited up to a predetermined capacity before the driver comfortably feels cool. Moreover, when an amount of ventilation is not sufficient, the cooling capacity probably becomes insufficient. To avoid the abovementioned state, when the predetermined setting valve of the suction pressure is lowered too much, a mileage of an engine may become worse or the room of the car may be over-cooled. Furthermore, it is required for the variable capacity compressor that a load for the compressor is to be lightened so that a performance as the car takes precedence over that of the air-conditioning and the engine is protected so as not to get overload. However, the above-mentioned several requirements cannot be satisfied by only the control for keeping the suction pressure constant.

In view of above, several control devices have been proposed and developed to satisfy the above-mentioned requirements. But, there remain some problems, e.g. how a pressure control valve can be simplified, miniaturized and presented by a low price. Also, there remains a problem what is to be used as control signals.

OBJECT AND SUMMARY OF THE INVENTION

The object of the present invention is to offer a variable capacity compressor which is simplified and has applicability to needs for multi-functions.

In order to achieve the above-mentioned object, a variable capacity compressor comprises a compressor which has control means for controlling an amount of exhaust gas by control pressure supplied to the control means, and control pressure supply means which supplies the control pressure to the control means, the control pressure supply means comprising:

a pressure detecting part which compares suction pressure of the compressor with atmospheric pressure, thereby to generate a displacement thereof, a valve urged to close by a spring, a rod driven by the pressure detecting part for opening the valve, and an electromagnetic coil for applying electromagnetic force to the valve, thereby to urge the valve in a direction to open.

The above-mentioned variable capacity compressor can change the cooling capacity continuously. Therefore, this variable capacity compressor enables to control the cooling capacity with a fine adjustment as necessity requires and also enables to minimize the cooling capacity, thereby to minimize torque thereof at the time of starting or accelerating of the car.

BRIEF DESCRIPTION OF THE DRAWINGS

FIG. 8 is the basic structural view of the conventional variable capacity compressor.

DESCRIPTION OF THE PREFERRED EMBODIMENTS

Figure 1:
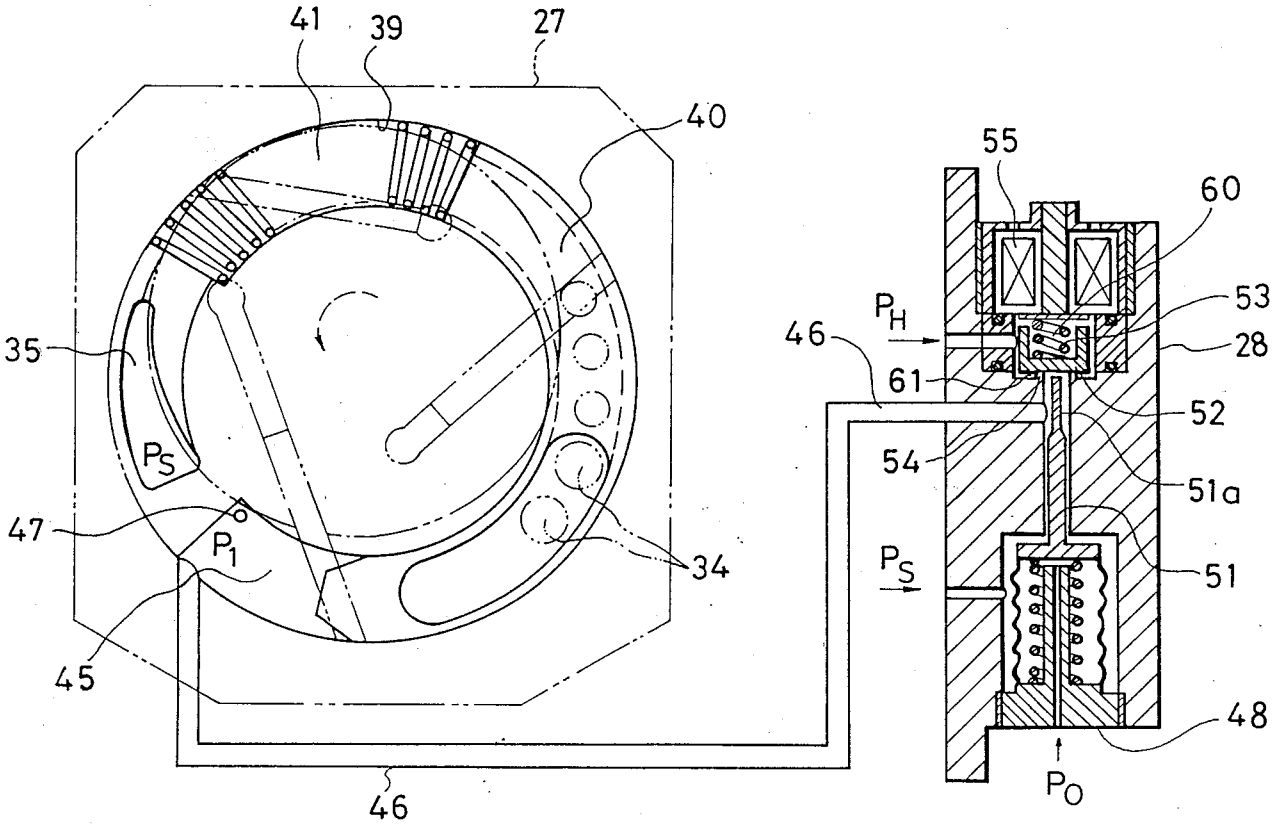
FIG. 1 is a schematic illustration showing both a control mechanism and a pressure control valve of a variable capacity compressor of an embodiment of the present invention.
Figure 2:
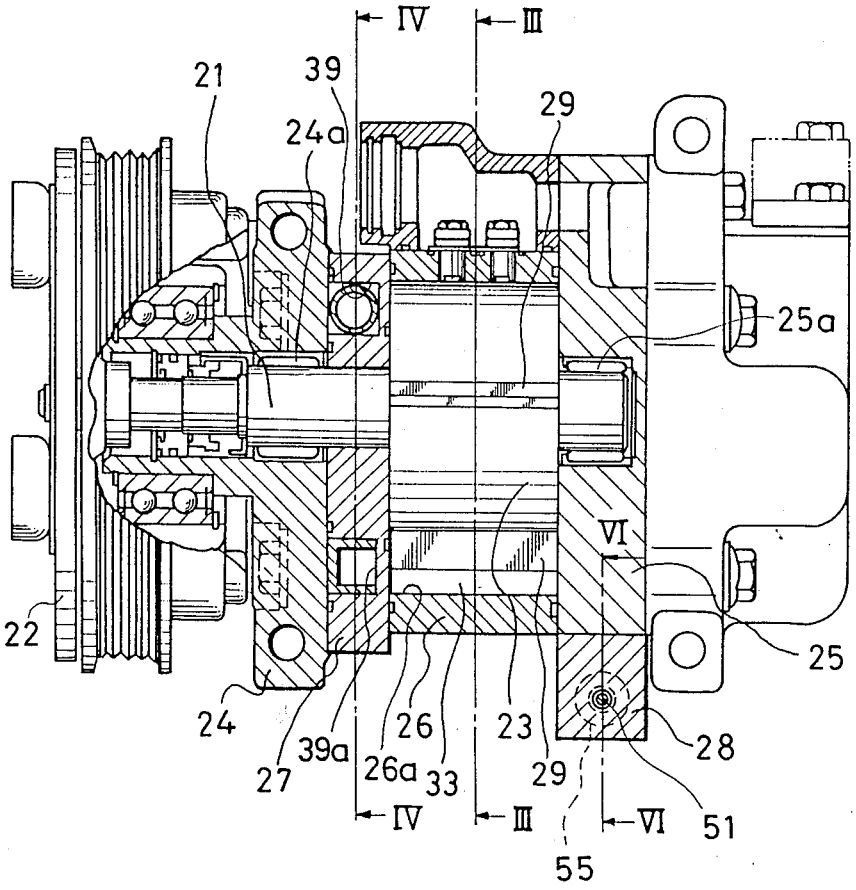
FIG. 2 is a cross-sectional view showing an embodiment of a variable capacity compressor of the present invention.

Hereafter, preferred embodiment of the present invention is described with reference to the accompanying drawings. FIG. 1 is a schematic illustration showing both a control mechanism and a pressure control valve of a variable capacity compressor, and FIG. 2 is a cross-sectional view of the variable capacity compressor. In FIG. 2, a shaft 21 is rotated by receiving driving force of an engine (not shown) via an electromagnetic clutch 22. A rotor 23 which is shrunk on the shaft 21 is rotatably held by bearings 24*a* and 25*a*, which are provided in a front plate 24 and a rear plate 25, respectively. A cylinder 26 has a cylindrical inner wall 26*a* therein, and the rotor 23 is excentrically disposed in the cylinder 26, thereby to be close in with a part of the inner wall 26*a* of the cylinder 26. A intermediate plate 27 is put and secured between the front plate 24 and the cylinder 26. A pressure control valve 28 is provided in a lower end part of the rear plate 25.

Figure 3:
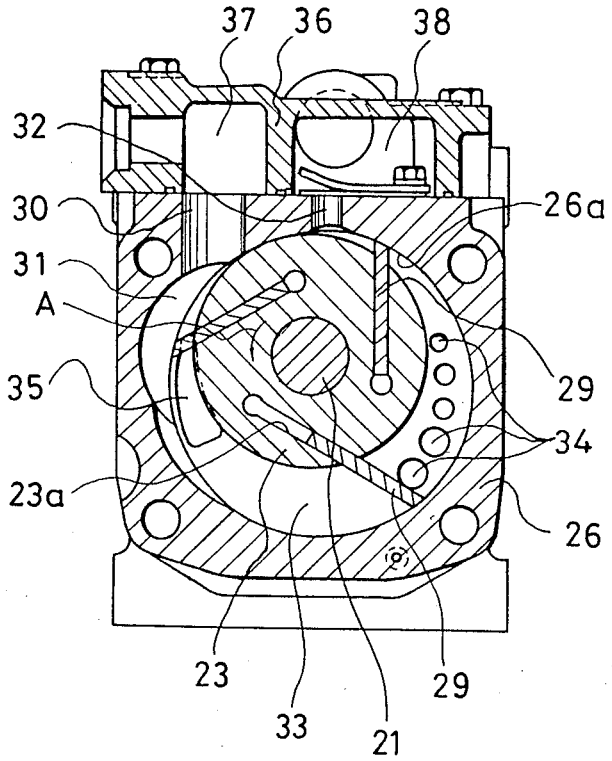
FIG. 3 is a cross-sectional view taken on line III—III of FIG. 2.

FIG. 3 is a cross-sectional view taken on line III—III of FIG. 2, and shows a compression part of the variable capacity compressor. Vanes 29 are slidably inserted into the rotor 23 and are urged out of slits 23*a* by pressure supplied to the slits 23*a*. A suction inlet 30, a suction hollow 31 and an exhaust outlet 32 are formed in the cylinder 26. A cylinder-head cover 36, which is fixed on the cylinder 26, has a suction compartment 37 connected to the suction inlet 30 and an exhaust compartment 38 connected to the exhaust outlet 32. In the cylinder compartment 33, a volume of space sectioned by the vanes 29, the inner wall 26*a* and the rotor 23 is cyclically increased and decreased by rotation of the rotor 23, and thereby a refrigerant gas is sucked from the suction compartment 37 through the suction inlet 30 and is pressurized in the cylinder compartment 33, and thereafter the gas is exhausted to the exhaust compartment 38 through the exhaust outlet 32. Thus, the refrigerant gas is circulated. Plural return ports 34 are formed on the intermediate plate 27 (FIG. 2) so as to connect a volume-decrease-step space, which is a space sectioned by the vanes 29 in the cylinder compartment 33 and is to be decreased by rotation of the rotor 23. The return ports 34 are disposed in an arc-shaped arrangement in such manner that diameters thereof decrease one by one in a rotating direction "A" of the rotor 23. An exit 35, which is formed on the intermediate plate 27 and is connected to the return ports 34 through a guide passage 39 (FIG. 2), opens in a volume-increase-step space which is sectioned by the vanes 29 in the cylinder compartment 33 and is to be increased by rotation of the rotor 23.

Figure 4:
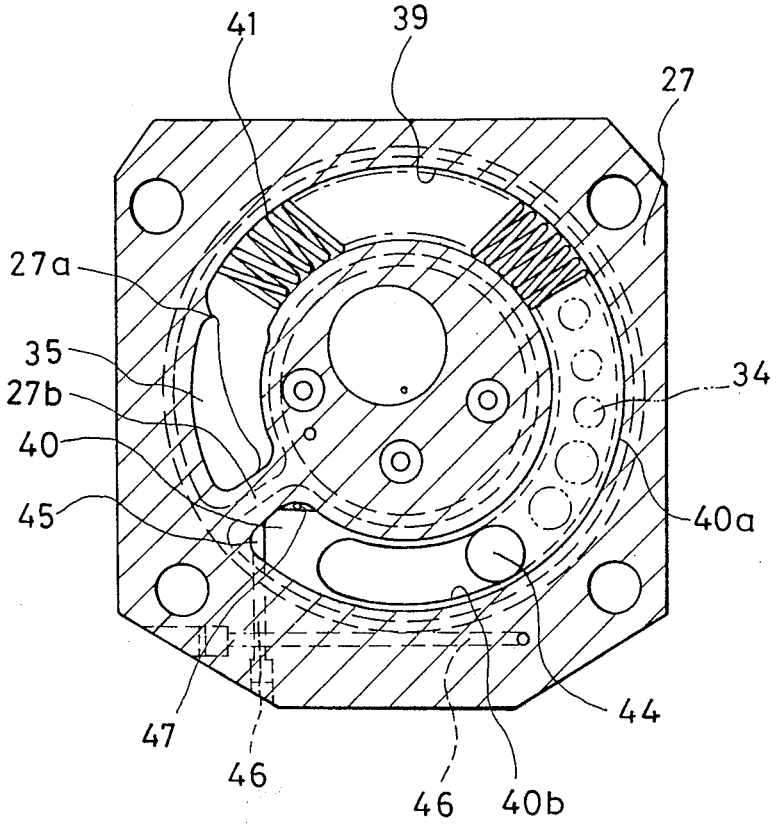
FIG. 4 is a cross-sectional view taken on line IV—IV of FIG. 2.
Figure 5:
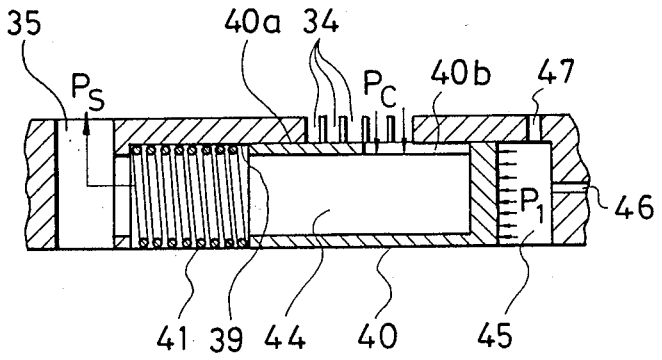
FIG. 5 is a cross-sectional and linear extended development view along a guide passage 39 of FIG. 4.

FIG. 4 is a cross-sectional view taken on line IV—IV of FIG. 2, and shows a variable control part of the capacity. The return ports 34 and the exit 35, which are formed on a surface faced to the cylinder compartment 33 (FIG. 2), are disposed in an arc-shaped arrangement on the guide passage 39. The guide passage 39 is a groove formed on the surface of the intermediate plate 27 which faces the front plate 24 (FIG. 2) and has a C-shaped configuration, i.e., an arc-shape having a large arc-angle with a tiny sealing part 27*b* remained between both ends thereof. In the guide passage 39, an arc-shaped slider 40 is slidably provided and a bias spring 41 is expansibly/shrinkably provided between an anti-clockwise end of the slider 40 and a projection 27*a* in order to urge the slider 40. The slider 40 has both an arc-shaped oblong aperture 40*b* for opening the return ports 34 and a sealing part 40*a* for closing the return ports 34 on a surface thereof faced to a bottom 39*a* (FIG. 2) of the guide passage 39. And a passage 44 for connecting to the exit 35 is formed in an approximate center part of the slider 40. The slider 40 is urged clockwise by the bias spring 41, thereby to close the return ports 34. A pressure lead-in pipe 46 is connected to a pressure control compartment 45 which is formed between both clockwise ends of the guide passage 39 and the slider 40; and an orifice 47 connects the pressure control compartment 45 to the cylinder compartment 33 (FIG. 3). FIG. 5 is a cross-sectional and linear extended development view along the guide passage 39 of FIG. 4 for reference.

Figure 6:
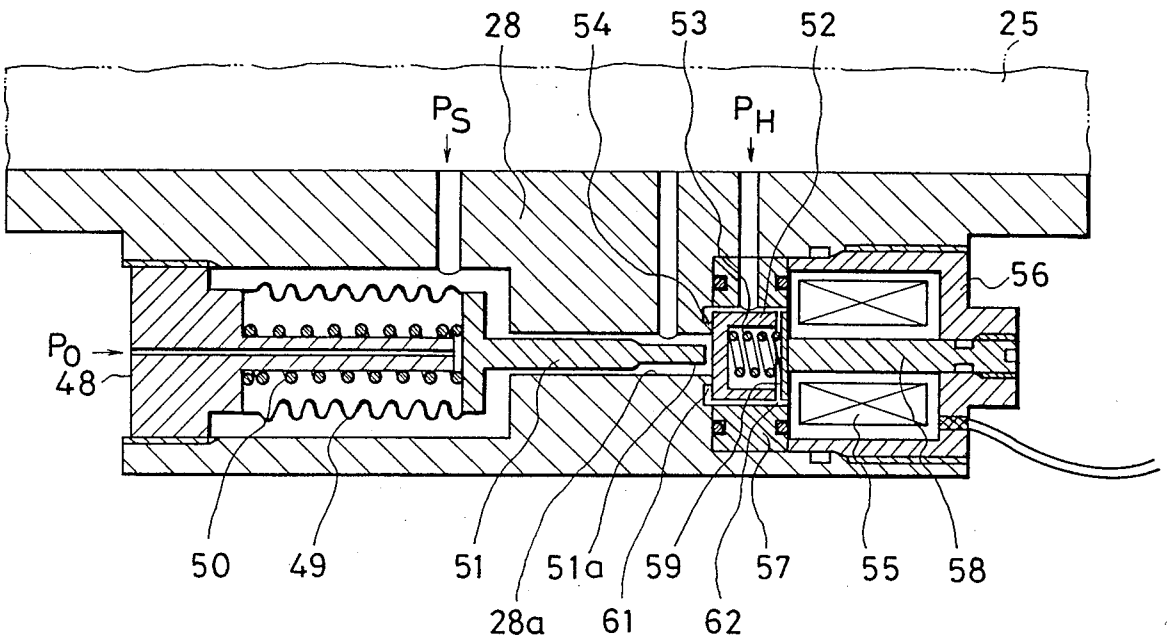
FIG. 6 is a cross-sectional view taken on line VI—VI of FIG. 2.

FIG. 6 is a cross-sectional view taken on line VI—VI of FIG. 2 and shows the pressure control valve 28. In the figure, a pressure detecting part 48 comprises a bellows 49 and a spring 50. The bellows 49 expands/shrinks by differential pressure between suction pressure $P_s$ applied to an external part of the bellows 49 and the atmospheric pressure $P_o$ applied to an internal part of that. A rod 51 is welded to the bellows 49, and an end 51*a* of the rod 51 is projected in order to push a valve 52 rightward of the figure. The rod 51 slides in a guide hole 28*a* with each other gas-tightly sealed. The valve 52 serves to control a lead-in amount of a high-pressure gas $P_H$. The valve 52 is pushed to a valve bank 54 by a spring 53. A ring 57 is provided around the valve 52, and a cylindrical cover 56 is provided around an electromagnetic coil 55. A plunger 58 is provided at a center position of the electromagnetic coil 55. These ring 57, valve 52, cover 56 and plunger 58 are made by a magnetic material and forms a magnetic circuit therein. Between the valve 52 and the electromagnetic coil 55, a shim 59 of non-magnetic material, such as brass, is provided.

Figure 7A:
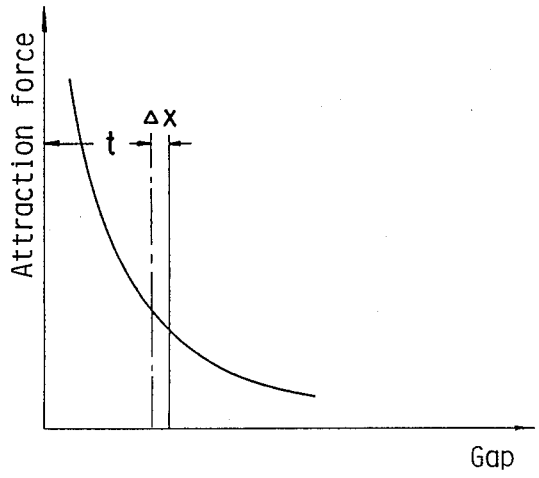
FIG. 7(*a*) and FIG. 7(*b*) are graphs showing characteristics of an electromagnetic coil 55 in FIG. 6.
Figure 7B:
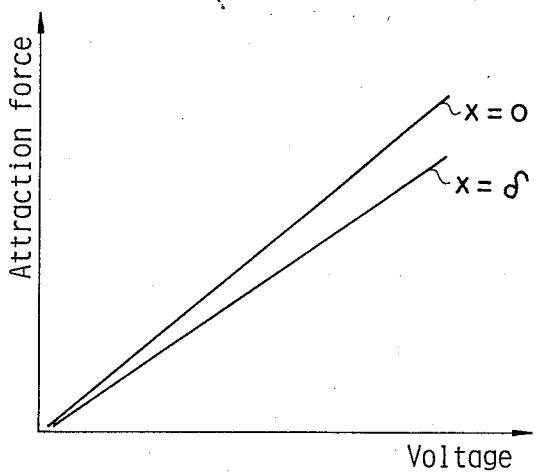

FIG. 7(*a*) is a graph showing a relation of electromagnetic attraction force versus a gap 62 (FIG. 6) formed between a right end of the valve 52 urged by the spring 53 and a left end of the electromagnetic coil 55. In the figure, a thickness of the shim 59 is represented by "t", and a movable range of the valve 52 is represented by "$\Delta x$". As shown in the figure, the movable range $\Delta x$ is very small (about 0.2–0.3 mm), and therefore the change of the electromagnetic attraction force is made very small.

FIG. 7(*b*) is a graph showing a relation between the electromagnetic attraction force and voltage supplied to the electromagnetic coil 55 about two values (0 or δ) of a displacement x of the valve 52. As shown in the figure, the electromagnetic attraction force increases in proportion to increase of the voltage. When the valve 52 is attracted by the electromagnetic coil 55, force $F_x$ which pushes the valve 52 to the valve bank 54 is given by the following equation, in relation with force of the spring 53:

$$F_x = F_B + K_B x - (F_{VD} + F_V x).$$

When force by the pressure detecting part 48 is taken into account, a next equation holds:

$$\begin{aligned} A_B(P_{S0} - P_S) &= F_x + K_A x \\ &= (K_A + K_B - F_V)x + F_B - F_{VD}. \end{aligned}$$

Therefore, the displacement x is represented as follows:

$$x = \frac{A_B(P_{S0} - P_S) - F_B + F_{VD}}{K_A + K_B - F_V},$$

Wherein:

$F_B$; initial force of the spring 53 (x=0)

$K_B$; spring constant of the spring 53

$F_{VD}$; initial electromagnetic attraction force of the electromagnetic coil 55

$F_V$; changing ratio of attraction force against the displacement x $P_{SO}$; the initial suction pressure at an initial displacement x $P_S$; suction pressure $A_B$; effective cross-sectional area of the pressure detecting part 48

$K_A$; spring constant in the pressure detecting part 48.

In view of above relations, it is known that the displacement x is changeable by applying the electromagnetic attraction force $F_{VD}$. In other words, when the displacement x is set as zero in the last equation, the equation is reformed as follows:

$$P_{SO} = P_S + (F_{VD} - F_B)/A_B.$$

Therefore, the initial suction pressure $P_{SO}$ at the initial displacement x can be controlled by changing the electromagnetic attraction force $F_{VD}$.

Specifically, in the variable capacity compressor for keeping suction pressure constant, the suction pressure varies from 1.0 to 1.8 kg/cm²G by continuously changing the voltage from 0 to 8 V. Further, by applying the voltage of 10 V the valve 52 can be strongly attracted, thereby to open up the valve 52 maximum.

Next, operation of this variable capacity compressor is described referring to FIG. 1. At the time of starting of the compressor, maximum voltage (12 V) is applied to the electromagnetic coil 55. Under this state, the electromagnetic attraction force is stronger than force of the spring, and thereby the valve 52 is opened maximumly. At that time, some amount of the high pressure gas $P_H$ which is compressed by the compressor flows into a space 60 in the valve 52, and enters the supply pressure lead-in pipe 46 through a gap 61 formed between the valve 52 and the valve bank 54. Thereby, pressure $P_1$ in the pressure control compartment 45 of the mechanical plate 27 increases, and thereby the slider 40 slides to a position where the pressure $P_1$ is evenly balanced with the spring force of the bias spring 41 as shown in the figure. At that time, one or more return ports 34 become open. As a result, such amount of the gas corresponding to total area of the return ports 34 bypasses from the volume-decrease-step space of the compressor to the volume-increase-step space of that, through the opened return ports 34 and the guide passage 39. Therefore, substantial amount of the exhaust gas decreases, and thereby torque which is required for rotating the compressor is saved.

Subsequent thereto, when the rapid cooling of the room of car is required, the electricity onto the electromagnetic coil 55 is turned off. Thereby, since a setting valve of the suction pressure decreases to 1.0 kg/cm²(G), the capacity of the compressor is kept maximum until the suction pressure is made 1.0 kg/cm², thereby to cool rapidly. And thereafter, when the room of car is sufficiently cooled and the driver begins to feel chilly, the voltage applied to the electromagnetic coil 55 is set from 0 to 8 V, thereby to increase the setting value of the suction pressure from 1.0 to 1.8 kg/cm². This setting value should be adjusted at a person's request or seasons. Generally, in spring or autumn the setting value of 1.6–1.8 kg/cm² is desirable, and in summer the setting valve of 1.2–1.4 kg/cm² is desirable.

In the above-mentioned embodiment, though the pressure detecting part 48 comprises the bellows 49, a diaphragm is also applicable. Furthermore, although this variable capacity compressor adopts the cylinder-bypass system, another variable capacity system, which comprises a crank case of wobble plate type as a pressure control compartment and a piston having variable stroke, is also applicable.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A variable capacity compressor comprising:

an enclosure having cylindrical internal space, a cylindrical-shaped rotor which is rotatably held in said enclosure and driven by an external force and has vanes, plural return ports formed on a wall of volume-decrease-step space in said internal space wherein volume of sectioned space by movements of said rotor and said vanes is changed cyclically, an exit formed on said wall of volume-increase-step space in said internal space wherein volume of sectioned space by movements of said rotor and said vanes is changed cyclically, and a C-shaped guide passage formed in said wall for connecting said plural return ports and said exit;

an arc-shaped slider which is provided slidably in said guide passage for opening and closing said plural return ports with a pressure control compartment remained in said guide passage;

a bias spring for urging said slider in a direction to close said return ports; and control pressure supply means which supplies control pressure to said pressure control compartment and comprises a pressure detecting part which compares suction pressure with atmospheric pressure, thereby to generate a displacement thereof, a valve urged to close by a spring, a rod driven by said pressure detecting part for opening said valve, and an electromagnetic coil for applying electromagnetic force to said valve, thereby to urge said valve in a direction to open.

* * * * *